US005761633A

United States Patent [19]

Kong

[11] Patent Number: 5,761,633

[45] Date of Patent: Jun. 2, 1998

[54] METHOD OF ENCODING AND DECODING SPEECH SIGNALS

[75] Inventor: Byung-goo Kong, Anyang, Rep. of Korea

[73] Assignee: Samsung Electronics Co., Ltd., Kyungki-do, Rep. of Korea

[21] Appl. No.: 640,507

[22] Filed: May 1, 1996

Related U.S. Application Data

[63] Continuation-in-part of Ser. No. 366,725, Dec. 30, 1994, abandoned.

[30] Foreign Application Priority Data

Aug. 30, 1994 [KR] Rep. of Korea ..... 94-21563

[51] Int. Cl.[6] ..... G10L 9/00

[52] U.S. Cl. ..... 704/219; 704/220; 704/223; 704/211; 704/229

[58] Field of Search ..... 395/2.28, 2.29, 395/2.16, 2.2, 2.32

[56] References Cited

U.S. PATENT DOCUMENTS

| | | | |
|---|---|---|---|
| 4,047,108 | 9/1977 | Bijker et al. | 375/260 |
| 4,220,819 | 9/1980 | Atal | 395/2.28 |
| 4,667,340 | 5/1987 | Arjmand et al. | 395/2.16 |
| 4,731,846 | 3/1988 | Secrest et al. | 395/2.16 |
| 4,752,956 | 6/1988 | Sluijter | 395/2.28 |
| 4,890,327 | 12/1989 | Bertrand et al. | 395/2.28 |
| 4,965,789 | 10/1990 | Bottau et al. | 370/79 |
| 5,142,583 | 8/1992 | Galand et al. | 395/2.29 |
| 5,432,883 | 7/1995 | Yoshihara | 395/2.28 |
| 5,488,704 | 1/1996 | Fujimoto | 395/2.28 |
| 5,579,433 | 11/1996 | Jarvinen | 395/2.28 |
| 5,754,455 | 6/1988 | Yasunaga | 370/522 |

OTHER PUBLICATIONS

Yang et al., ("Error protection for a 4.8 KBPS VQ based CELP coder", IEEE, Vehicular Technology, Apr. 1990Conference, pp. 726–731).

*Primary Examiner*—David R. Hudspeth
*Assistant Examiner*—Vijay B. Chawan
*Attorney, Agent, or Firm*—Leydig, Voit & Mayer, Ltd.

[57] ABSTRACT

In a speech codec algorithm for low speed transmission, a first linear prediction analysis is performed for an input speech signal and a second linear prediction analysis is performed for a residual signal generated from the first linear prediction analysis. Low-pass-filtering utilizing a cut-off frequency of 2 kHz is employed to generate second linear prediction coefficients. The second linear prediction coefficients are transmitted to a receiver, together with the first linear prediction coefficients. A baseband signal is generated for the first linear prediction coefficients using the second linear prediction coefficients during reproduction of the speech signal, and the speech signal is restored using the baseband signal and the first linear prediction coefficients. Thus, a high-quality restored tone can be provided with a low-cost digital signal processor.

3 Claims, 1 Drawing Sheet

METHOD OF ENCODING AND DECODING SPEECH SIGNALS

This disclosure is a continuation-in-part of U.S. patent application Ser. No. 08/366,725, filed Dec. 30, 1994, now abandoned.

BACKGROUND OF THE INVENTION

The present invention relates to a speech encoder/decoder (codec) algorithm for low transmission late mode, and more particularly, to a speech codec algorithm providing good tonal quality at low transmission rate mode below 4.8 Kbps., According to a conventional speech codec technology as shown in FIG. 1, in which a code-excited linear prediction (CELP) or vector-sum-excited linear prediction (VSELP) is performed at a low transmission rate (below 4.8 Kbps), a linear prediction analyzer 1 performs a linear prediction analysis of a speech signal input and obtains a residual signal generated from a prediction error and a linear prediction coefficients. Here, the data amount of the linear prediction coefficients is relatively small, but that of the residual signal is great. Thus, when transmitting such a residual signal, the transmission speed should equal that of the original input speech signal.

Therefore, the data compression of the residual signal is very important technology in speech codecs operating in a low transmission rate mode. For this purpose, a vector quantizer 3 re-synthesizes the signal into a vector code composed of a constant number and selects the most sinilar code to the original signal. Thereafter, a second bit allocator 4 allocates a predetermined number of bite to the index of the vector code and a first bit allocator 2 transmits the index to which a predetermined bit number is allocated with linear prediction coefficients.

Here, in order to transmit the index, the transmitting and receiving parts must have the same code book and many calculations are required for seeking the most similar code to the original signal. Thus, real-time processing is not possible.

Meanwhile, a method was used in which the whole residual signal (about 4 KHz or below) is not coded, and only a residual signal of 800~1,000 Hz is extracted by using a low pass filter having a 1 KHz cut-off frequency, has a predetermined number of assigned bits, and is transmitted. In this case, however, even the residual signal has much tone color information between 1 KHz and 2 KHz, thereby deteriorating the timber of a restored speech signal.

SUMMARY OF THE INVENTION

To solve the above problem, it is an object of the present invention to provide a speech codec algorithm which affords a high quality tone at a low transmission rate mode.

To achieve the above object, a speech codec algorithm for low transmission rate mode comprises the steps of:

(a) performing a linear prediction analysis to an input speech signal which is windowed to a predetermined speech segment for encoding, to generate a first linear prediction coefficients and a residual signal;

(b) performing a low-pass-filtering to the residual signal, with cut-off frequency of 2 KHz;

(c) performing a linear prediction analysis to the low-pass-filtered residual signal, to generate a second linear prediction coefficients and pitch and amplitude values;

(d) allocating a predetermined bit number to each of the first and second linear prediction coefficientss and the pitch and amplitude values, to transmit to a receiver; and (e) generating a baseband signal of the first linear prediction coefficients using the second linear prediction coefficients and restoring the speech signal using the baseband signal and first linear prediction coefficients.

BRIEF DESCRIPTION OF THE DRAWINGS

The above objects and advantages of the present invention will become more apparent by describing in detail a preferred embodiment thereof with reference to the attached drawings in which.

DETAILED DESCRIPTION OF THE INVENTION

Figure 1:
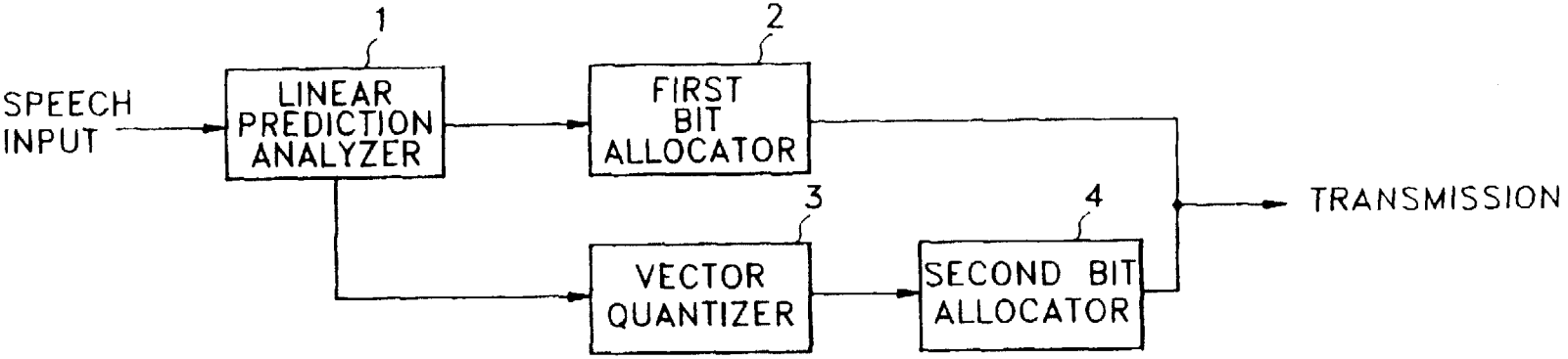
FIG. 1 (PRIOR ART)
FIG. 1 is a diagram illustrating a conventional speech codec algorithm for a low transmission rate mode.
Figure 2:
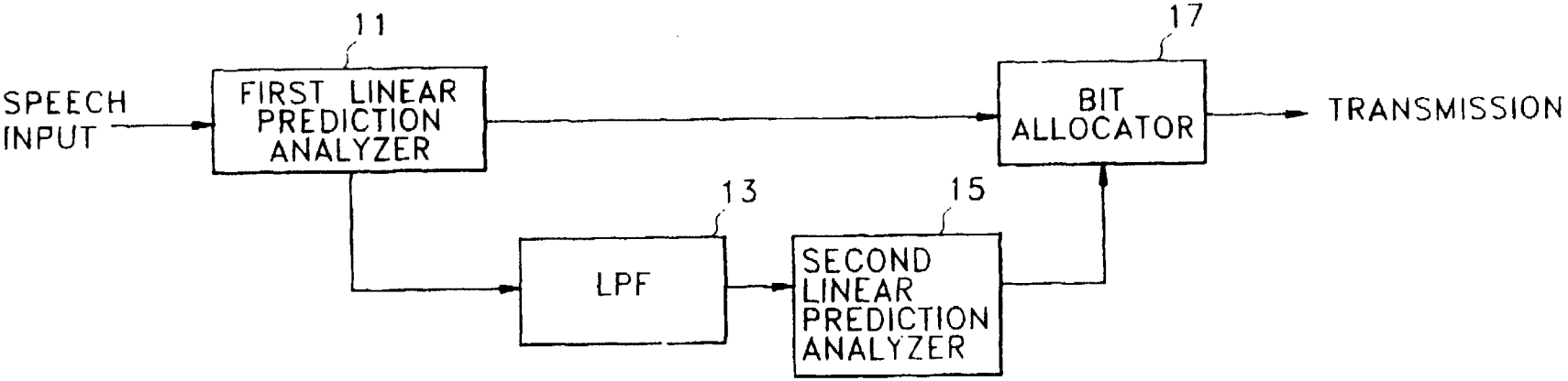
FIG. 2 is a diagram illustrating a speech codec algorithm for a low transmission rate mode according to the present invention.

The construction of the block diagram shown in FIG. 2 is composed of a first linear prediction analyzer 11 for performing a linear prediction analysis to the speech signal which is windowed as a predetermined length and for outputting a first linear prediction coefficients and residual signal, a low-pass filter for low-pass-filtering the residual signal output from first linear prediction analyzer 11, with cut-off frequency of 2 KHz, a second linear prediction analyzer 15 for performing a linear prediction analysis to the residual signal output from low-pass-filter 13 and for outputting a second linear prediction coefficients and pitch and amplitude values, and a bit-allocator 17 for allocating bits to the first and second linear prediction coefficients and the pitch and amplitude values so as to transmit to a receiver.

The operation of the speech codec algorithm according to the present invention is as follows.

The present invention is intended to achieve a low transmission rate mode by efficiently coding a residual signal and thus reducing the number of bits allocated for the residual signal.

Despite the drawbacks of incompetence in keeping a corelationship (e.g., an original speech signal) suitable for a linear prediction analysis and a signal characteristic near to noise, the residual signal has significant tone color information including tone and nasal sound components unique to an individual.

Therefore, it is very important to divide the residual signal into a frequency component of 2 KHz, or below and a frequency component above 2 KHz, to perform a second linear prediction analysis. Here, the residual signal having the frequency component of 2 KHz or below is efficiently coded by the second linear prediction, whereas the frequency component above 2 KHz is almost a noise component not to be coded, thus being excluded from transmission, and can be simply synthesized by a random noise generator according to residual magnitude information.

The reason for defining 2 KHz as a basis is that there does not exist sufficient tone color information in the range of 1 KHz or below. Accordingly, it is of no use to subject the residual signal to a low pass filtering, and the low pass filtering is set as a preliminary requisite for application of the second linear prediction analysis to the residual signal.

First of all, a speech signal to be encoded is input and windowing is performed in speech segment units of 20–30 ms. Then, first linear prediction analyzer 11 performs the first linear prediction analysis of the windowed signal, outputs the first linear prediction coefficients generated as the result to bit allocator 17 and outputs the residual signal generated by a prediction error to low-pass filter 13.

Next, low-pass filter 13 performs low-pass-filtering of the residual signal output from first linear prediction analyzer 11 and outputs the filtered residual signal to second linear prediction analyzer 15. Here, the cut-off frequency of low-pass filter 13 is 2 KHz.

Second linear prediction analyzer 11 performs the second linear prediction analysis to the residual signal output from low-pass filter 13 and outputs the second linear prediction coefficients and the pitch and amplitude values which are generated as the second linear prediction analysis to bit allocator 17.

Bit allocator 17 allocates a bit number to the first and second linear prediction coefficients and the pitch and amplitude values and transmits to the receiver. Here, bit allocator 17 allocates 48 -bits for the first linear prediction coefficients, 34-bits for the second linear prediction coefficients, 7-bits for pitch and 7-bits for amplitude over a 20 ms speech segment for an effective rate of 4.8 Kbps, that is, 96-bits in total.

The restoring process of the speech data transmitted from the receiver is the reverse procedure of the above-described encoding process. The signal generated from the second linear prediction coefficients is emphasized above 2 KHz and used as the baseband signal of the first linear prediction coefficients.

As described above, according to the speech codec algorithm for low transmission rate mode of the present invention, firstly, the first linear prediction analysis is performed for the speech signal and the second linear prediction analysis is performed for the residual signal generated from the first linear prediction analysis and then low-pass-filtered with cut-off frequency of 2 KHz to generate the second linear prediction coefficients. Thereafter, the second linear prediction coefficients are transmitted to a receiver, together with the first linear prediction coefficients whose baseband signal is generated using the second prediction coefficient during reproducing, and the speech signal is restored using the baseband signal and the first linear prediction coefficients. As a result, the restored tone has a higher quality than the conventional pseudo-code book searching algorithm and a low-priced digital signal processor (up to 20 MIPS) can be achieved.

Also, when using a code book, a signal for analysis is re-synthesized and comparative searching is performed to search the closest code vector. However, since the present invention does not require this kind of process, the amount of calculation can be remarkably reduced.

Also, the present invention can be applied to various kinds of digital mobile radio communication terminals, and the reduction of memory size and good tonal quality (as in the conventional vocoder) allows application to many fields.

What is claimed is:

1. A method for encoding and decoding a speech signal for low speed transmission comprising:

(a) selecting a speech segment of an input speech signal for encoding;

(b) performing a first linear prediction analysis of the speech segment for encoding, to generate first linear prediction coefficients and a residual signal;

(c) low-pass-filtering the residual signal, utilizing a cut-off frequency of 2 kHz to eliminate a signal components above 2 kHz and produce a low-pass-filtered residual signal;

(d) performing a second linear prediction analysis of the low-pass-filtered residual signal to generate second linear prediction coefficients a pitch value, and an amplitude value;

(e) allocating a number of bits to each of the first and second linear prediction coefficients, the pitch value, and the amplitude value, to produce an output signal for transmission to a receiver;

(f) transmitting the output signal to the receiver; and (g) generating a baseband signal from the first linear prediction coefficients using the second linear prediction coefficients and restoring the input speech signal using the baseband signal and the first linear prediction coefficients.

2. The method for encoding and decoding a speech signal for low speed transmission as claimed in claim 1, including emphasizing the baseband signal generated from the second linear prediction coefficients above 2 kHz, thereby compensating for the signal components eliminated by the low-pass-filtering.

3. The method for encoding and decoding a speech signal for low speed transmission as claimed in claim 1, wherein allocating a predetermined number of bits comprises allocating 48 bits for the first linear prediction coefficients, 34 bits for the second linear prediction coefficients, 7 bits for the pitch value, and 7 bits for the amplitude value when the speech segment comprises a 20 ms speech segment, and including transmitting the output signal comprises at an effective bit rate of 4.8 kbps.

* * * * *